US008905708B2

(12) United States Patent
Weber et al.

(10) Patent No.: US 8,905,708 B2
(45) Date of Patent: Dec. 9, 2014

(54) TURBINE ASSEMBLY AND METHOD FOR CONTROLLING A TEMPERATURE OF AN ASSEMBLY

(75) Inventors: David Wayne Weber, Simspsonville, SC (US); Christopher Lee Golden, Greer, SC (US)

(73) Assignee: General Electric Company, Schenectady, NY (US)

( * ) Notice: Subject to any disclaimer, the term of this patent is extended or adjusted under 35 U.S.C. 154(b) by 480 days.

(21) Appl. No.: 13/347,284

(22) Filed: Jan. 10, 2012

(65) Prior Publication Data

US 2013/0177386 A1 Jul. 11, 2013

(51) Int. Cl.
*F01D 25/12* (2006.01)

(52) U.S. Cl.
USPC ..... 415/110; 415/115; 415/139; 415/173.1; 415/173.4; 415/191

(58) Field of Classification Search
CPC F01D 11/005; F01D 2240/81; F01D 2240/11
USPC ..... 415/1, 110, 115, 116, 139, 171.1, 415/173.1, 173.4, 191
See application file for complete search history.

(56) References Cited

U.S. PATENT DOCUMENTS

| | | | | |
|---|---|---|---|---|
| 4,650,394 | A | 3/1987 | Weidner | |
| 4,902,198 | A | 2/1990 | North | |
| 5,167,485 | A | 12/1992 | Starkweather | |
| 5,531,437 | A | 7/1996 | Coombs | |
| 5,531,457 | A | 7/1996 | Tibbott et al. | |
| 6,270,311 | B1 * | 8/2001 | Kuwabara et al. | 415/110 |
| 6,340,285 | B1 | 1/2002 | Gonyou et al. | |
| 6,814,538 | B2 | 11/2004 | Thompson | |
| 7,217,081 | B2 * | 5/2007 | Scheurlen et al. | 415/1 |
| 8,182,208 | B2 * | 5/2012 | Bridges et al. | 415/139 |
| 8,371,800 | B2 | 2/2013 | Meenakshisundaram et al. | |
| 2011/0217155 | A1 * | 9/2011 | Meenakshisundaram et al. | 415/1 |

FOREIGN PATENT DOCUMENTS

| | | | |
|---|---|---|---|
| EP | 2365188 | A1 | 9/2011 |
| GB | 2239679 | A | 7/1991 |
| WO | 9618025 | A1 | 6/1996 |

OTHER PUBLICATIONS

Search Report and Written Opinion from EP Application No. 13150631.3 dated May 24, 2013.

* cited by examiner

*Primary Examiner* — Igor Kershteyn
(74) *Attorney, Agent, or Firm* — Cantor Colburn LLP

(57) ABSTRACT

According to one aspect of the invention, a turbine assembly includes a first component, a second component circumferentially adjacent to the first component, wherein the first and second components each have a surface proximate a hot gas path and a first side surface of the first component to abut a second side surface of the second component. The assembly also includes a first slot formed longitudinally in the first side surface, a second slot formed longitudinally in the second side surface, wherein the first and second slots are configured to receive a sealing member, and a first groove formed in a hot side surface of the first slot, the first groove extending axially from a leading edge to a trailing edge of the first component.

5 Claims, 3 Drawing Sheets

TURBINE ASSEMBLY AND METHOD FOR CONTROLLING A TEMPERATURE OF AN ASSEMBLY

BACKGROUND OF THE INVENTION

The subject matter disclosed herein relates to gas turbines. More particularly, the subject matter relates to an assembly of gas turbine stator components.

In a gas turbine engine, a combustor converts chemical energy of a fuel or an air-fuel mixture into thermal energy. The thermal energy is conveyed by a fluid, often air from a compressor, to a turbine where the thermal energy is converted to mechanical energy. Several factors influence the efficiency of the conversion of thermal energy to mechanical energy. The factors may include blade passing frequencies, fuel supply fluctuations, fuel type and reactivity, combustor head-on volume, fuel nozzle design, air-fuel profiles, flame shape, air-fuel mixing, flame holding, combustion temperature, turbine component design, hot-gas-path temperature dilution, and exhaust temperature. For example, high combustion temperatures in selected locations, such as the combustor and areas along a hot gas path in the turbine, may enable improved efficiency and performance. In some cases, high temperatures in certain turbine regions may shorten the life and increase thermal stress for certain turbine components.

For example, stator components circumferentially abutting or joined about the turbine case are exposed to high temperatures as the hot gas flows along the stator. Accordingly, it is desirable to control temperatures in the stator components to reduce wear and increase the life of the components.

BRIEF DESCRIPTION OF THE INVENTION

According to one aspect of the invention, a turbine assembly includes a first component, a second component circumferentially adjacent to the first component, wherein the first and second components each have a surface proximate a hot gas path and a first side surface of the first component to abut a second side surface of the second component. The assembly also includes a first slot formed longitudinally in the first side surface, a second slot formed longitudinally in the second side surface, wherein the first and second slots are configured to receive a sealing member, and a first groove formed in a hot side surface of the first slot, the first groove extending axially from a leading edge to a trailing edge of the first component.

According to another aspect of the invention, a method for controlling a temperature of an assembly of circumferentially adjacent first and second stator components includes flowing a hot gas within the first and second stator components and flowing a cooling fluid along an outer portion of the first and second stator components and into a cavity formed by first and second slots in the first and second stator components, respectively. The method also includes receiving the cooling fluid around a seal member located within the cavity and directing the cooling fluid axially in a groove along a hot side surface of each of the first and second slots to control a temperature of the first and second stator components.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
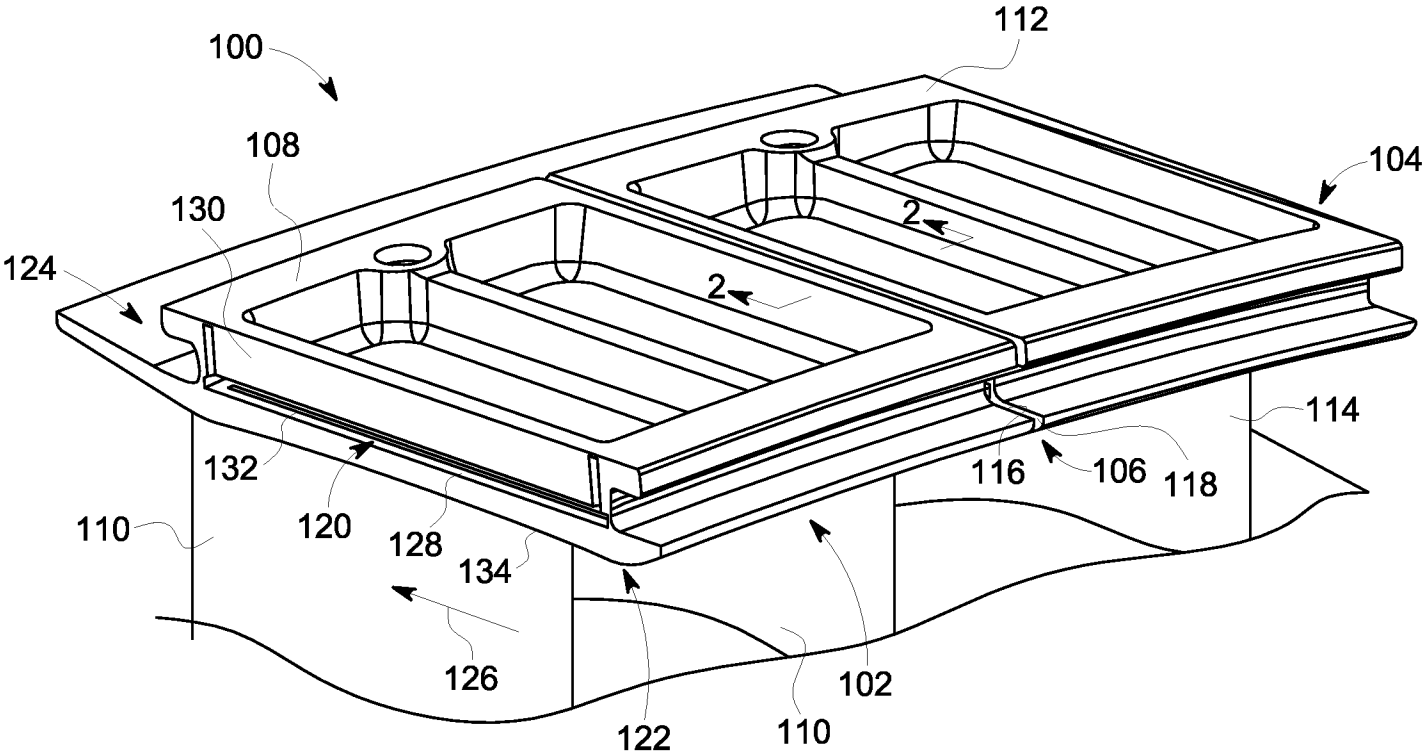
FIG. 1 is a perspective view of an embodiment of a turbine stator assembly.

FIG. 1 is a perspective view of an embodiment of a turbine stator assembly 100. The turbine stator assembly 100 includes a first component 102 circumferentially adjacent to a second component 104. The first and second components 102, 104 are shroud segments that form a portion of a circumferentially extending stage of shroud segments within the turbine of a gas turbine engine. In an embodiment, the components 102 and 104 are nozzle segments. For purposes of the present discussion, the assembly of first and second components 102, 104 are discussed in detail, although other stator components within the turbine may be functionally and structurally identical and apply to embodiments discussed. Further, embodiments may apply to adjacent stator parts sealed by a shim seal.

The first component 102 and second component 104 abut one another at an interface 106. The first component 102 includes a band 108 with airfoils 110 (also referred to as "vanes" or "blades") rotating beneath the band 108 within a hot gas path 126 or flow of hot gases through the assembly. The second component 104 also includes a band 112 with an airfoil 114 rotating beneath the band 112 within the hot gas path 126. In a nozzle embodiment, the airfoils 110, 114 extend from the bands 108, 112 (also referred to as "radially outer members" or "outer/inner sidewall") on an upper or radially outer portion of the assembly to a lower or radially inner band (not shown), wherein hot gas flows across the airfoils 110, 114 and between the bands 108, 112. The first component 102 and second component 104 are joined or abut one another at a first side surface 116 and a second side surface 118, wherein each surface includes a longitudinal slot (not shown) formed longitudinally to receive a seal member (not shown). A side surface 120 of first component 102 shows details of a slot 128 formed in the side surface 120. The exemplary slot 128 may be similar to those formed in side surfaces 116 and 118. The slot 128 extends from a leading edge 122 to a trailing edge 124 portion of the band 108. The slot 128 receives the seal member to separate a cool fluid, such as air, proximate an upper portion 130 from a lower portion 134 of the first component 102, wherein the lower portion 134 is proximate hot gas path 126. The depicted slot 120 includes a groove 132 formed in the slot 120 for cooling the lower portion 134 and surface of the component proximate the hot gas path 126. In embodiments, the slot 120 includes a plurality of grooves 132. In embodiments, the grooves 132 may include surface features to enhance the heat transfer area of the grooves, such as wave or bump features in the groove. In an embodiment, the first component 102 and second component 104 are adjacent and in contact with or proximate to one another. Specifically, in an embodiment, the first component 102 and second component 104 abut one another or are adjacent to one another. Each component may be attached to a larger static member that holds them in position relative to one another.

As used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The term "radial" refers to movement or position perpendicular to an axis or center line. It may be useful to describe parts that are at differing radial positions with regard to an axis. In this case, if a first component resides closer to the axis than a second component, it may be stated herein that the first component is "radially inward" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. Although the following discussion primarily focuses on gas turbines, the concepts discussed are not limited to gas turbines.

Figure 2:
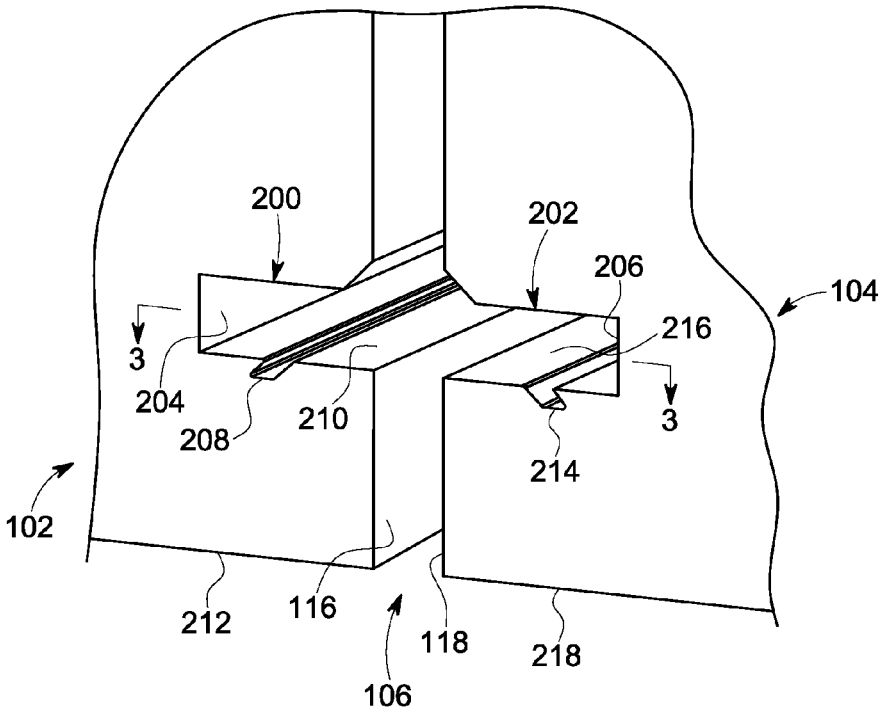
FIG. 2 is a detailed perspective view of portions of the turbine stator assembly from FIG. 1, including a first and second component.

FIG. 2 is a detailed perspective view of portions of the first component 102 and second component 104. As depicted, the interface 106 shows a substantial gap or space between the components 102, 104 to illustrate certain details but may, in some cases, have side surfaces 116 and 118 substantially in contact with or proximate to one another. The band 108 of the first component 102 has a slot 200 formed longitudinally in side surface 116. Similarly, the band 112 of the second component 104 has a slot 202 formed longitudinally in side surface 118. In an embodiment, the slots 200 and 202 run substantially parallel to the hot gas path 126 and a turbine axis. The slots 200 and 202 are substantially aligned to form a cavity to receive a sealing member (not shown). As depicted, the slots 200 and 202 extend from inner walls 204 and 206 to side surfaces 116 and 118, respectively. A groove 208 is formed in a hot side surface 210 of the slot 200. Similarly, a groove 214 is formed in a hot side surface 216 of the slot 202. The hot side surfaces 210 and 216 are described as such due to their proximity, relative to other surfaces of the slots, to the hot gas path 126. The hot side surfaces 210 and 216 may also be referred to as on a lower pressure side of the slots 200 and 202, respectively. In addition, hot side surfaces 210 and 216 are proximate surfaces 212 and 218, which are radially inner surfaces of the bands 108 and 112 exposed to the hot gas path 126. As will be discussed in detail below, the grooves 208 and 214 are configured to cool portions of the bands 108 and 112 in the hot side surfaces 210 and 216, respectively.

Figure 3:
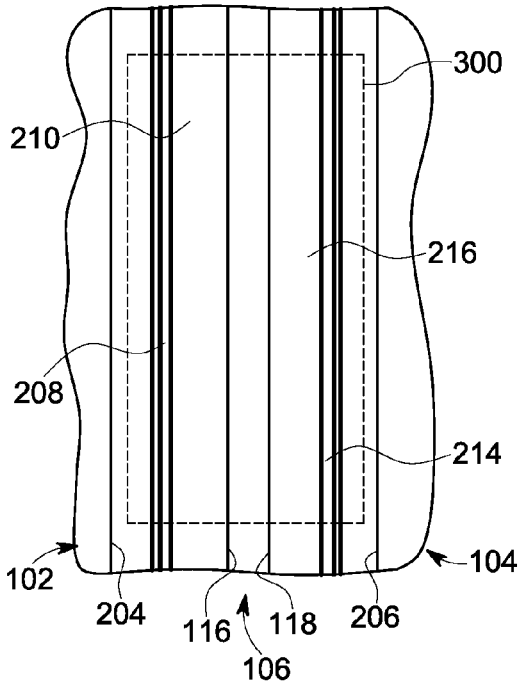
FIG. 3 is a top view of a portion of the first component and second component from FIG. 2.

FIG. 3 is a top view of a portion of the first component 102 and second component 104. The slots 200 and 202 are configured to receive a sealing member 300. The grooves 208 and 214 receive a cooling fluid, such as air, to cool the first and second components 102 and 104 below the sealing member 300. In an embodiment, the sealing member 300 is positioned on hot side surfaces 210 and 216, and remains there due to a higher pressure radially outside relative to the pressure radially inside the member 300. When placed on hot side surfaces 210 and 216, the sealing member 300 forms substantially closed passages for cooling fluid flow in grooves 208 and 214. As depicted, the grooves 208 and 214 are substantially parallel to one another and side surfaces 116. Further the grooves 208 may be described as running substantially axially within slots 200 and 202 (also referred to as "longitudinal slots"). In other embodiments, the grooves 208 and 214 may be formed at angles relative to side surfaces 116 and 118. As depicted, the grooves 208 and 214 comprise an angled U-shaped cross-sectional geometry. In other embodiments, the grooves 208 and 214 may include a U-shaped, V-shaped, tapered (wherein a radially inner portion of the groove is larger than the outer portion), or other suitable cross-sectional geometry. The depicted arrangement of grooves 208 and 214 provides improved cooling which leads to enhanced component life.

Figure 4:
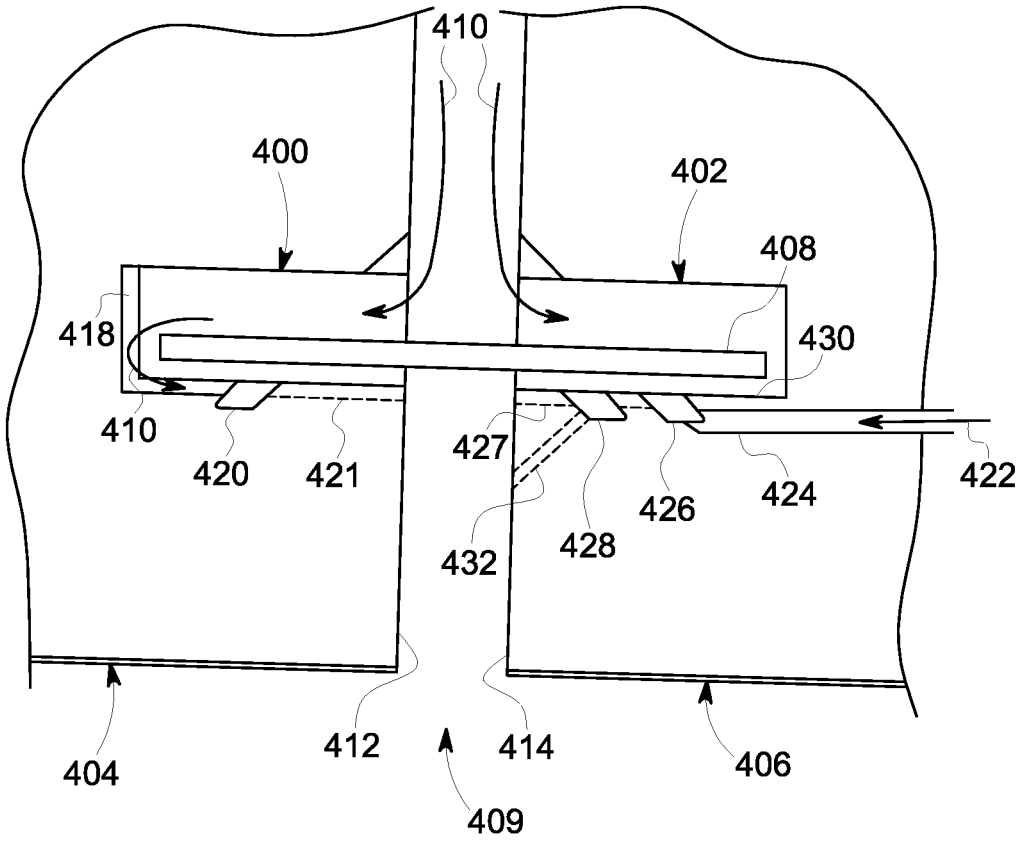
FIG. 4 is an end view of another embodiment of a first component and second component of a turbine stator assembly.

FIG. 4 is an end view of a portion of another embodiment of a turbine stator assembly that includes a sealing member 408 positioned within longitudinal slots 400 and 402 of a first component 404 and second component 406, respectively. An interface 409 between side surfaces 412 and 414 receives a cooling fluid flow 410 from a radially outer portion of the components 404 and 406. The cooling fluid flow 410 is directed into the slots 400 and 402, around the sealing member 408 and into one or more passages or lateral grooves 418 in first component 404. The lateral grooves 418 are used to supply the cooling fluid flow 410, which flows axially along groove 420 to cool the first component 404. In an embodiment, the cooling fluid flow 410 flows from one or more lateral grooves 418 and enters the groove 420 proximate a leading edge side of the slot 400, flows axially along the groove 420, and exits the groove 420 proximate a trailing edge side of the slot 400 via a one or more channels 421, which directs the fluid into interface 409. In one embodiment, the cooling fluid flow 410 enters the groove 420 proximate a trailing edge side of the slot 400, flows axially along the groove 420, and exits the groove 420 proximate a leading edge side of the slot 400. As shown in second component 406, a cooling fluid flow 422 is supplied to the groove 426 via a passage 424 formed in the component. The cooling fluid flow 422 may be supplied by any suitable source, such as a dedicated fluid or cooling air from outside the component. The passage 424 may be formed by casting, drilling (EDM) or any other suitable technique. In an embodiment, the cooling fluid flow 422 enters the groove 426 proximate a leading edge side of the slot 402, flows axially along the groove 426, and exits the groove 426 proximate a trailing edge side of the slot 402 via a channel 427, which directs the fluid into interface 409. Moreover, in an embodiment, an additional groove 428 is formed in a hot side surface 430 of the slot 402, wherein the groove 428 further enhances cooling of the second component 406. The groove 428 may be substantially identical to, in fluid communication with, and parallel to groove 426. In one embodiment, the cooling fluid flow 422 flows axially along the groove 426, and exits the groove 426 via a passage 432, which directs the fluid into interface 409. In addition, the axial groove 426 may comprise a series of axial grooves spanning from the leading edge to the trailing edge of the slot 400. For example, the groove 426 may receive fluid flow 422 proximate a leading edge of the slot 400 and allow axial flow of the fluid for a selected distance in the hot side surface 430, wherein the fluid exits passage 432. Another groove proximate to the trailing edge, relative to groove 426, may receive fluid from slot 402 and allow axial flow that is released through channel 427. Features of the first and second components 404 and 406 may be included in embodiments of the assemblies and components described above in FIGS. 1-3. In an embodiment, the assemblies include grooves that extend along longitudinal slots to improve cooling of components, reduce wear and extend component life.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine assembly comprising:

a first component;

a second component circumferentially adjacent to the first component, wherein the first and second components each have a surface proximate a hot gas path;

a first side surface of the first component to abut a second side surface of the second component;

a first slot formed longitudinally in the first side surface;

a second slot formed longitudinally in the second side surface, wherein the first and second slots are configured to receive a sealing member;

a first groove formed in a hot side surface of the first slot, the first groove extending axially along the first component; and a second groove formed in a hot side surface of the second slot, the second groove extending axially along the second component;

a lateral groove formed in the hot side surface of the first slot, the lateral groove extending from proximate an inner wall of the first slot, wherein the lateral groove routes a cooling fluid to the first groove, wherein the cooling fluid enters the first groove proximate a trailing edge side of the first groove and exits the first groove proximate a leading edge side of the first groove;

an inlet passage extending circumferentially in the second component and configured to route cooling fluid to the second groove.

2. The turbine assembly of claim 1, wherein the first groove comprises a U-shaped cross-sectional geometry.

3. The turbine assembly of claim 1, wherein the first groove comprises a tapered cross-sectional geometry.

4. The turbine assembly of claim 3, wherein the tapered cross-sectional geometry comprises a narrow passage in the hot side surface leading to a larger cavity radially inward of the narrow passage.

5. The turbine assembly of claim 1, comprising a plurality of first grooves formed in the hot side surface of the first slot, each of the first grooves extending axially from the leading edge to the trailing edge of the first component.

* * * * *